US006453619B1

(12) United States Patent
Delamare

(10) Patent No.: US 6,453,619 B1
(45) Date of Patent: Sep. 24, 2002

(54) DEPLOYABLE AND STORABLE INFLATABLE BUILDING

(75) Inventor: Guy Robert Delamare, Le Pecq (FR)

(73) Assignee: Spironef Technologies, Sene (FR)

( * ) Notice: Subject to any disclaimer, the term of this patent is extended or adjusted under 35 U.S.C. 154(b) by 0 days.

(21) Appl. No.: 09/582,166

(22) PCT Filed: Dec. 9, 1998

(86) PCT No.: PCT/FR98/02675

§ 371 (c)(1),
(2), (4) Date: Nov. 7, 2000

(87) PCT Pub. No.: WO99/34078

PCT Pub. Date: Jul. 8, 1999

(30) Foreign Application Priority Data

Dec. 24, 1997 (FR) ..... 97 16525

(51) Int. Cl.[7] ..... E04H 15/20; E04G 11/04

(52) U.S. Cl. ..... 52/2.11; 52/2.13; 52/2.23; 52/2.25; 52/3; 52/64

(58) Field of Search ..... 52/2.11, 2.13, 52/2.21, 2.22, 2.23, 2.24, 2.25, 3, 64

(56) References Cited

U.S. PATENT DOCUMENTS 4,976,074 A * 12/1990 Delamare ..... 52/2.23
5,303,516 A * 4/1994 Delamare ..... 52/2.11
5,305,561 A * 4/1994 Goddard ..... 52/2.22
5,526,610 A * 6/1996 Delamare ..... 52/2.24
5,675,938 A * 10/1997 McLorg ..... 52/2.26
5,913,775 A * 6/1999 Delamare ..... 52/2.11
6,065,252 A * 5/2000 Norsen ..... 52/66

FOREIGN PATENT DOCUMENTS

| | | |
|---|---|---|
| EP | 0 647 751 | 4/1995 |
| FR | 2 070 982 | 9/1971 |
| WO | 96/38642 | 12/1996 |

* cited by examiner

*Primary Examiner*—Carl D. Friedman
*Assistant Examiner*—Brian E. Glessner
(74) *Attorney, Agent, or Firm*—Wenderoth, Lind & Ponack, L.L.P.

(57) ABSTRACT

A canopy which can be inflated, deployed and retracted by inflation and deflation, respectively. The canopy includes a plurality of beams arranged side by side, an apparatus for supplying the inflatable beams with pressurized fluid, an apparatus for sliding the beams along a rigid beam and at least one orifice made in the wall of the rigid beam placing the apparatus for supplying pressurized-fluid-supply in communication with the inner space of the inflatable beams. The canopy also includes an apparatus for successive positioning of the inner space of each inflatable beam opposite the orifice of the rigid beam to guarantee inflation of the beams by the pressurized fluid from the upper beam to the lower beam and their deflation from the lower beam to the upper beam.

27 Claims, 17 Drawing Sheets

DEPLOYABLE AND STORABLE INFLATABLE BUILDING

BACKGROUND OF THE INVENTION

The subject of the present invention is a canopy which can be inflated, deployed and retracted by means of inflation and deflation, respectively.

Generally speaking, inflatable canopies comprise a plurality of longitudinal beams placed side by side, means for sliding at least one end of the beams along at least one deployment and refolding path and means for supplying the beams with pressurized fluid.

This type of canopy is designed, amongst other things, to allow its deployment by simple inflation and its retraction by deflation, which makes it possible, at will, to cover over a space in order to protect it against bad weather and to uncover it in fine weather.

Such a canopy may be used temporarily to cover over diverse installations such as, for example, a stadium or a swimming pool.

An inflatable canopy in which each beam includes two opposite panels forming a flange and each constituting one of the lobes of the inner and outer wall of the canopy and two lateral panels forming the web of the beam is known, more particularly, from FR-A2,621,944.

The means for supplying each beam with inflation fluid are formed by at least one conduit passing through the beams and being extendible in terms of its length, its drawing-out and its retraction being controlled by the deployment and retraction, respectively, of the canopy.

In this canopy, the supply conduit is common to all the beams and communicates with each of the beams via an orifice which can be closed off and is controlled by closing-off means and the supply conduit passes through, in a leaktight manner, an opening made in each of the panels of the beams.

An inflatable beam in which the sliding means of the beams are formed by a pressurized-fluid-conveying channel for the inflation or deflation of the beams communicating, firstly, at at least one of its ends with the pressurized-fluid-supply means and, secondly, with the inside of at least one inflatable beam via at least one orifice made in the wall of the channel and equipped with closing-off means is also known from FR-A-2,734,856.

The closing-off means are formed by leaktight gates associated with means for controlling their opening or their closing.

However, a structure of this type poses problems of leaktightness and is complex because of the design of the inflation or deflation means and the closing-off means.

SUMMARY OF THE INVENTION

The subject of the invention is therefore a canopy which can be inflated, deployed and retracted by inflation and deflation, respectively, the canopy comprising:

a plurality of inflatable beams arranged side by side;

means for supplying the inflatable beams with pressurized fluid;

means for sliding the beams along at least one deployment or refolding path formed by a rigid beam passing, in a leaktight manner, through these beams and forming a fluid-conveying channel linked to the pressurized-fluid-supply means;

at least one orifice made in the wall of the rigid beam placing the pressurized-fluid-supply means in communication with the inner space of the inflatable beams;

means for the leaktight linking of the adjacent walls of the contiguous inflatable beams around the rigid beam;

means for spacing, around the rigid beam, the walls of the upper inflatable beam;

at least one bearing element of the inflatable beams; characterized in that the canopy includes means for successive positioning of the inner space of each inflatable beam opposite the orifice of the rigid beam to guarantee inflation of the beams by the pressurized fluid from the upper beam to the lower beam and their deflation from the lower beam to the upper beam.

According to other characteristics of the invention:

the means for successive positioning of the inner space of each inflatable beam opposite the orifice are actuated automatically by the flow of pressurized fluid supplying the inflatable beams, the orifice of the rigid beam is located opposite the inner space of the upper beam in the deflated state of the inflatable beams and opposite the inner space of the lower beam in the inflated state of the inflatable beams, the means for successive positioning of the inner space of each inflatable beam are formed by at least one wedge associated with the stacking of the inflatable beams and arranged in the vicinity of the rigid beam, the wedge is formed by an inflatable cushion, which can be retracted by deflation, communicating with the pressurized-fluid-supply means or with the outside air via a three-way valve, the pressurized-fluid-supply means of the cushion are formed by the pressurized-fluid-supply means of the inflatable beams, the wedge is formed by a superposition of inflatable cushions which can be retracted by deflation, each cushion being connected separately, by means of a valve, to a pressurized-fluid-supply source, the means for successive positioning of the inner space of each inflatable beam are formed by at least one ram arranged between the lower beam and the corresponding bearing element and below the means for leaktight linking of the lower wall of the beam around the rigid beam;

the positioning means also comprise at least one auxiliary wedge arranged in the inner space of an inflatable beam and in the vicinity of the rigid beam, the auxiliary wedge being formed by an inflatable cushion, which can be retracted by deflation, communicating with the inner space of the inflatable beam located above;

at least one communication orifice is made between two contiguous inflatable beams, equipped with a non-return valve arranged above this orifice and displaceable between an open position placing the inner spaces of the contiguous inflatable beams in communication and a closed position closing off the orifice;

the pressurized-fluid-supply means are formed by an exhauster including a delivery orifice and an aspiration orifice and by a member for reversing the direction of flow of the fluid formed by a hose intended to be connected to one of the orifices and including a non-return valve;

the canopy includes at least one cushion for lifting the upper beam during refolding of the canopy, the cushion being inflatable and retractable by deflation and being arranged between the upper inflatable beam and the corresponding bearing element.

BRIEF DESCRIPTION OF THE DRAWINGS

Further characteristics and advantages of the invention will become apparent during the following description which is given with reference to the appended drawings, in which.

DETAILED DESCRIPTION OF THE PREFERRED EMBODIMENTS

Figure 1:
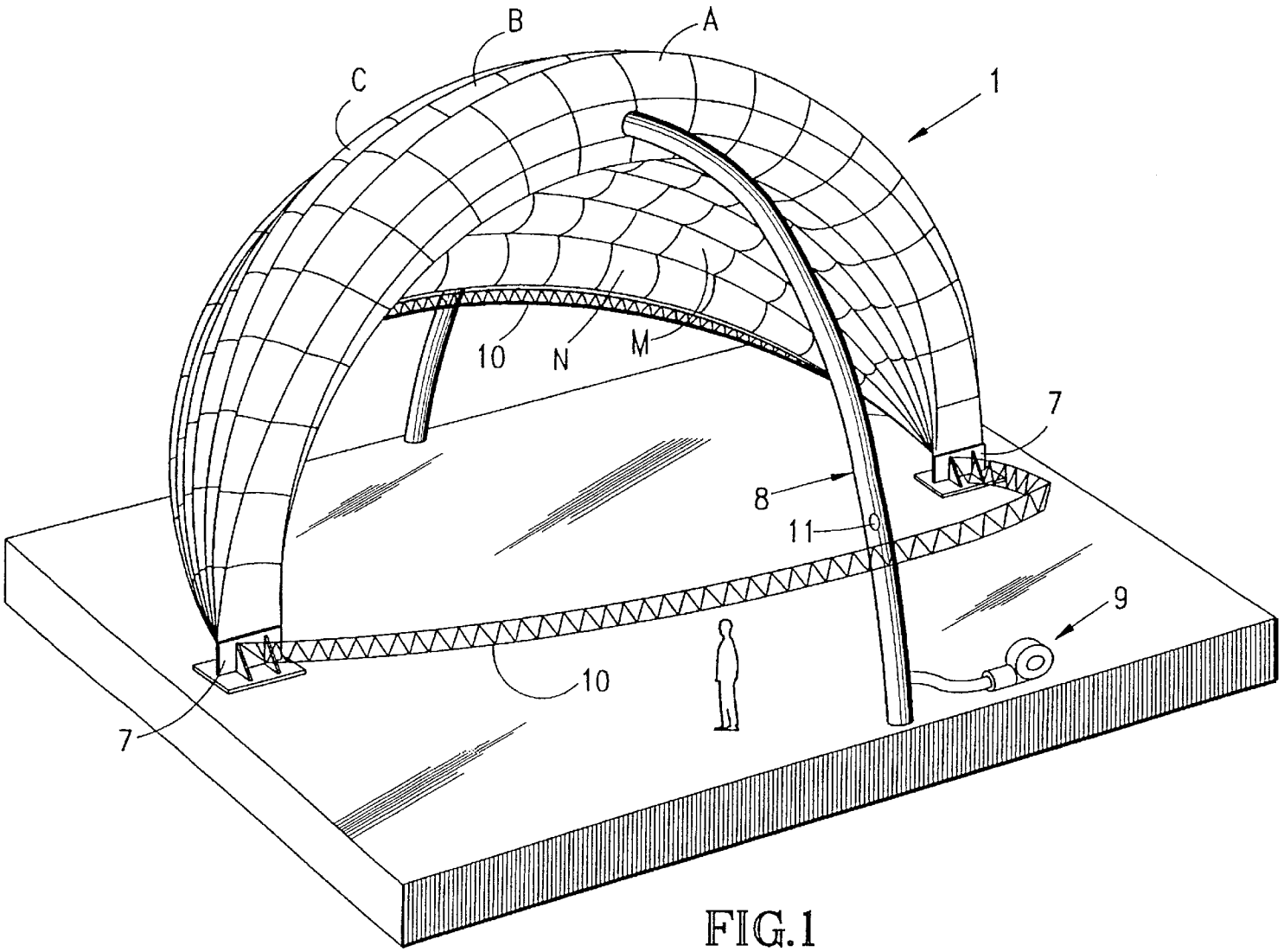
FIG. 1 is a diagrammatic perspective view of a deployable and retractable canopy according to the invention.
Figure 2:
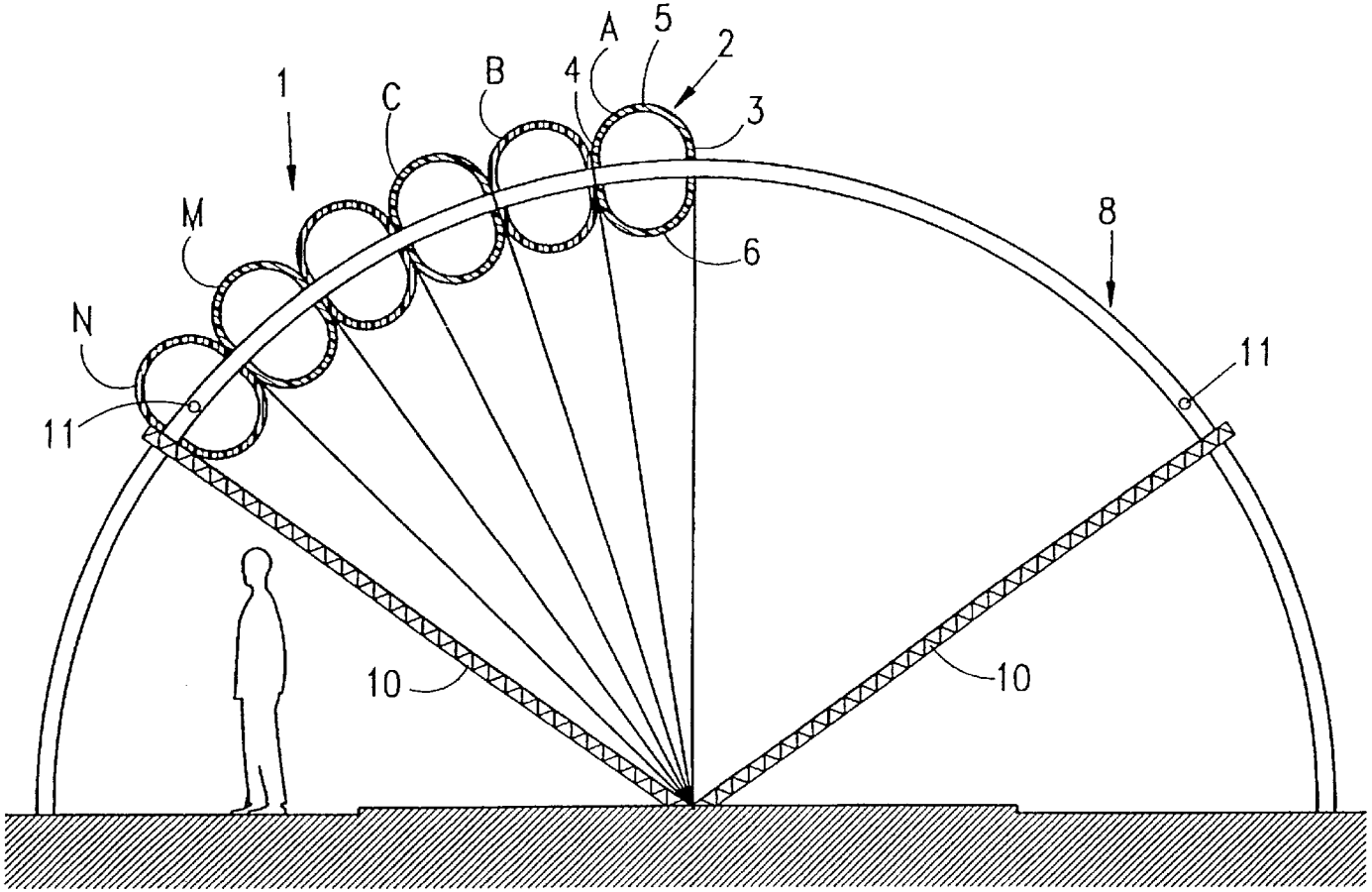
FIG. 2 is a diagrammatic view in transverse section of the inflatable canopy according to the invention.

FIGS. 1 and 2 diagrammatically show an inflatable canopy 1 including a plurality of longitudinal inflatable beams A, B, C . . . M, N which are leaktight and arranged side by side in order to form the canopy 1.

This canopy 1 may include a series of inflatable beams A, B, C . . . which covers over the space to be protected by itself or of two symmetrical series of inflatable beams A, B, C . . . covering over the entire space to be protected.

The beams A, B, C . . . are connected together longitudinally by linking means which are described below.

As shown in FIG. 2, each beam A, B, C . . . includes a tubular envelope 2 providing the continuity of the leaktightness of the volume it confines and composed of four zones, two lateral zones of which form the webs 3 and 4 and two, upper and lower, zones of which form an outer flange 5 and an inner flange 6, respectively.

These beams A, B, C . . . are connected at at least one end to foundation or ballasting means 7 fastened to the ground.

The canopy 1 includes means for sliding the beams A, B, C . . . along at least one deployment or refolding path formed by a rigid beam 8 passing through these beams in a leaktight manner and forming a fluid-conveying channel connected to pressurized-fluid-supply means 9.

In the embodiment shown in FIGS. 1 and 2, the canopy 1 also includes two bearing elements 10, one for the inflatable beams A, B, C . . . in the deflated state and in contact with the lower inflatable beam N and the other, opposite, in contact with the upper inflatable beam A when the beams are in the inflated state.

These bearing elements 10 are each formed, for example, by an arch-shaped support extending parallel to the beam with which it is in contact. Each bearing element 10 is, firstly, fastened to the ground at both of its ends and, secondly, supported in its central part by the rigid beam 8.

Depending on its structure, the canopy 1 may include only one bearing element 10.

To permit inflation of the beams A, B, C . . . or the deflation of these beams, the wall of the rigid beam 8 includes at least one orifice 11 placing the pressurized-fluid-supply means 9 in communication with the inner space 2*a* of the inflatable beams one after the other.

If the canopy 1 includes a series of inflatable beams A, B, C . . . , the wall of the rigid beam 8 includes an orifice 11 arranged above the bearing element 10 of the inflatable beams A, B, C . . . in the deflated state and if the canopy includes two series of inflatable beams A, B, C . . . and A', B', C' . . . the wall of the rigid beam 8 includes two orifices 11 each arranged above the bearing element 10 of these beams of each series in the deflated state.

Figure 3:
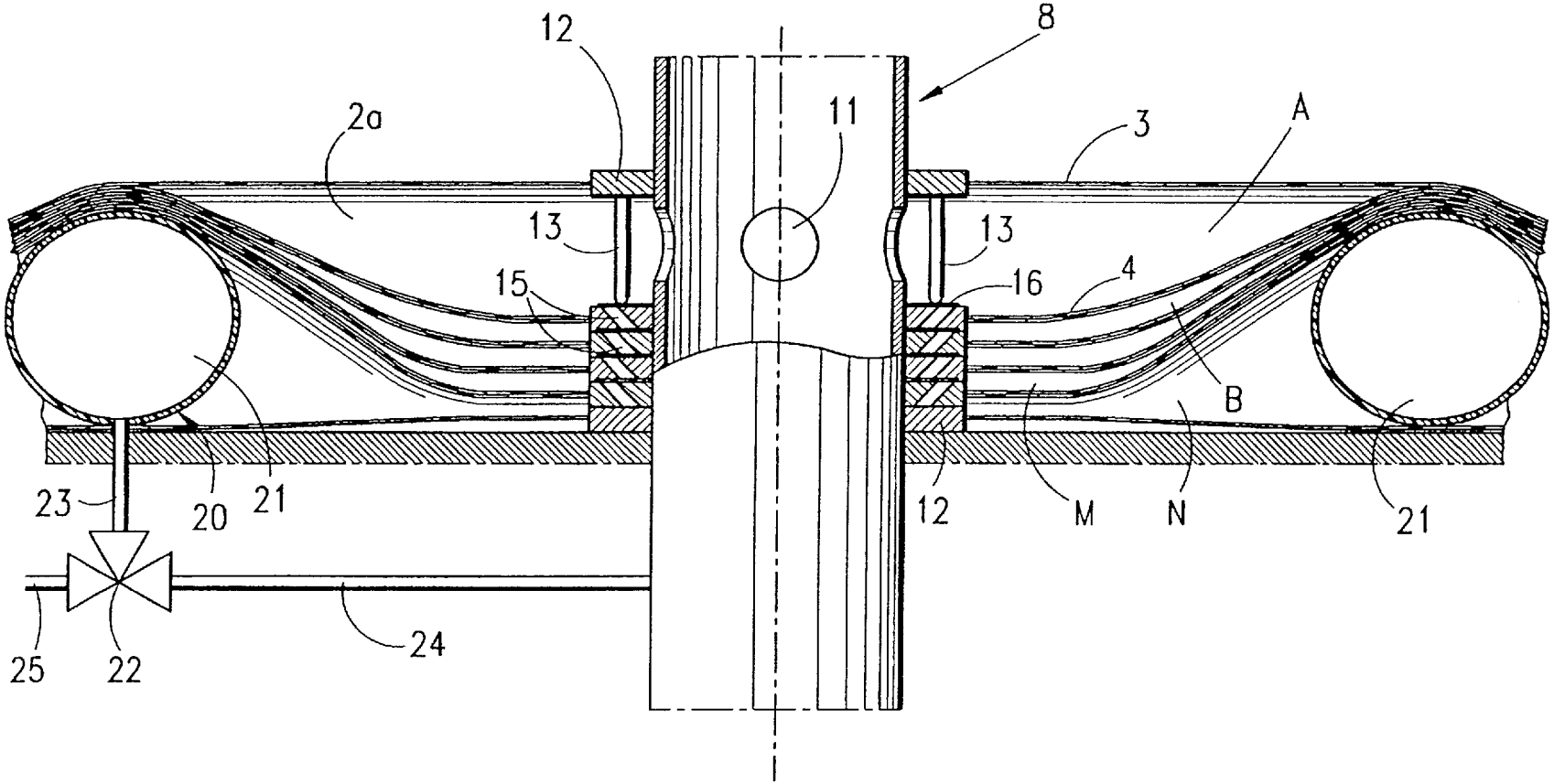
FIGS. 3 and 4 are diagrammatic views in transverse section showing the means for successive positioning of the inner space of each inflatable beam.

Generally speaking, the orifice 11 of the rigid beam 8 is located opposite the inner space 2*a* of the upper beam A in the deflated state of the inflatable beams A, B, C . . . , as shown in FIG. 3, and opposite the inner space of 2*a* of the lower beam N in the inflated state of the inflatable beams.

Figure 4:
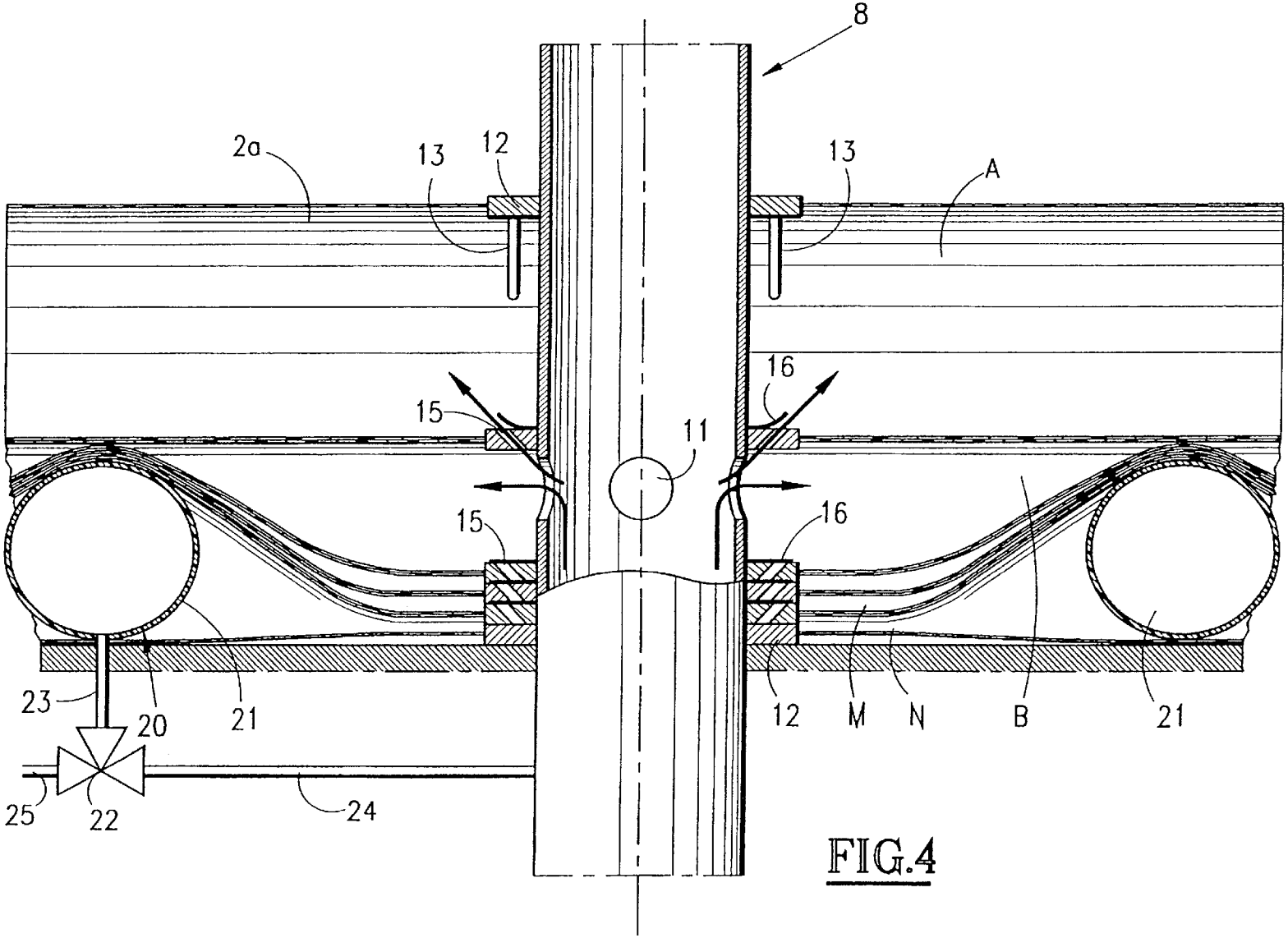

As shown more particularly in FIGS. 3 and 4, the means for leaktight linking of the adjacent walls of the contiguous inflatable beams A, B, C . . . are formed, for example, by plates 12 which hold the lateral walls 3 and 4 of the contiguous beams A, B, C . . . and which slide in a leaktight manner over the rigid beam 8 during inflation or deflation of the beams A, B, C . . . .

Around the rigid beam 8, the upper beam A includes means for separating the lateral walls 3 and 4 of this upper beam A.

These separation means are formed, for example, by spacers 13 arranged between the plates 12 and holding the lateral walls 3 and 4, respectively of the upper beam A apart.

Thus, the spacers 13 make it possible to keep the lateral walls 3 and 4 of the upper beam A apart in such a manner that the inner space 2*a* of the upper beam A is opposite the orifice 11 when the inflatable beams A, B, C . . . are in the deflated state, as shown in FIG. 3.

Finally, the canopy 1 includes means 20 for successive positioning of the inner space 2*a* of each inflatable beam A, B, C . . . opposite the orifice 11 of the rigid beam 8 for inflation of the beams A, B, C . . . by the inflation fluid from the upper beam A to the lower beam N and their inflation from the lower beam N to the upper beam A.

The means 20 for successive positioning of the inner space 2*a* of each inflatable beam A, B, C . . . opposite the orifice 11 may be actuated automatically by the flow of pressurized fluid for supplying these inflatable beams.

These positioning means 20 are formed by at least one wedge 21 associated with the stacking of the inflatable beams A, B, C . . . and arranged in the vicinity of the rigid beam 8.

The wedge 21 is arranged either inside the lower inflatable beam N, as shown in FIGS. 3 and 4 or between the lower beam N and the bearing element 10 of the inflatable beams A, B, C . . . in the deflated state.

The wedge 21 consists, for example, of a single wedge arranged on one side of the rigid beam 8 or by two independent wedges arranged on either side of this rigid beam 8 or by a single wedge in the form of a ring arranged around the rigid beam 8.

Preferably, the wedge 21 is formed by an inflatable cushion, which can be retracted by deflation, communicating with the pressurized-fluid-supply means 9.

To this end, the cushion 21 is connected to a three-way valve 22 by a conduit 23 and this three-way valve 22 communicates, firstly, with the rigid beam 8 via a conduit 24 or, secondly, with a conduit 25 to the outside air, as shown in FIGS. 3 and 4.

The contiguous inflatable beams A, B, C . . . communicate with one another via an orifice 15 made in the plates 12 connecting the lateral walls 3 and 4 of the contiguous inflatable beams A, B, C . . .

Each orifice 15 is equipped with a non-return valve 16 consisting, for example, of a flexible membrane which is displaceable between an open position placing the inner spaces 2*a* of the contiguous inflatable beams A, B, C . . . in communication and a closed position closing off the corresponding orifice 15. The non-return valve 16 is arranged above the orifice 15, i.e. on the upper face of the corresponding plate 12.

Figure 5:
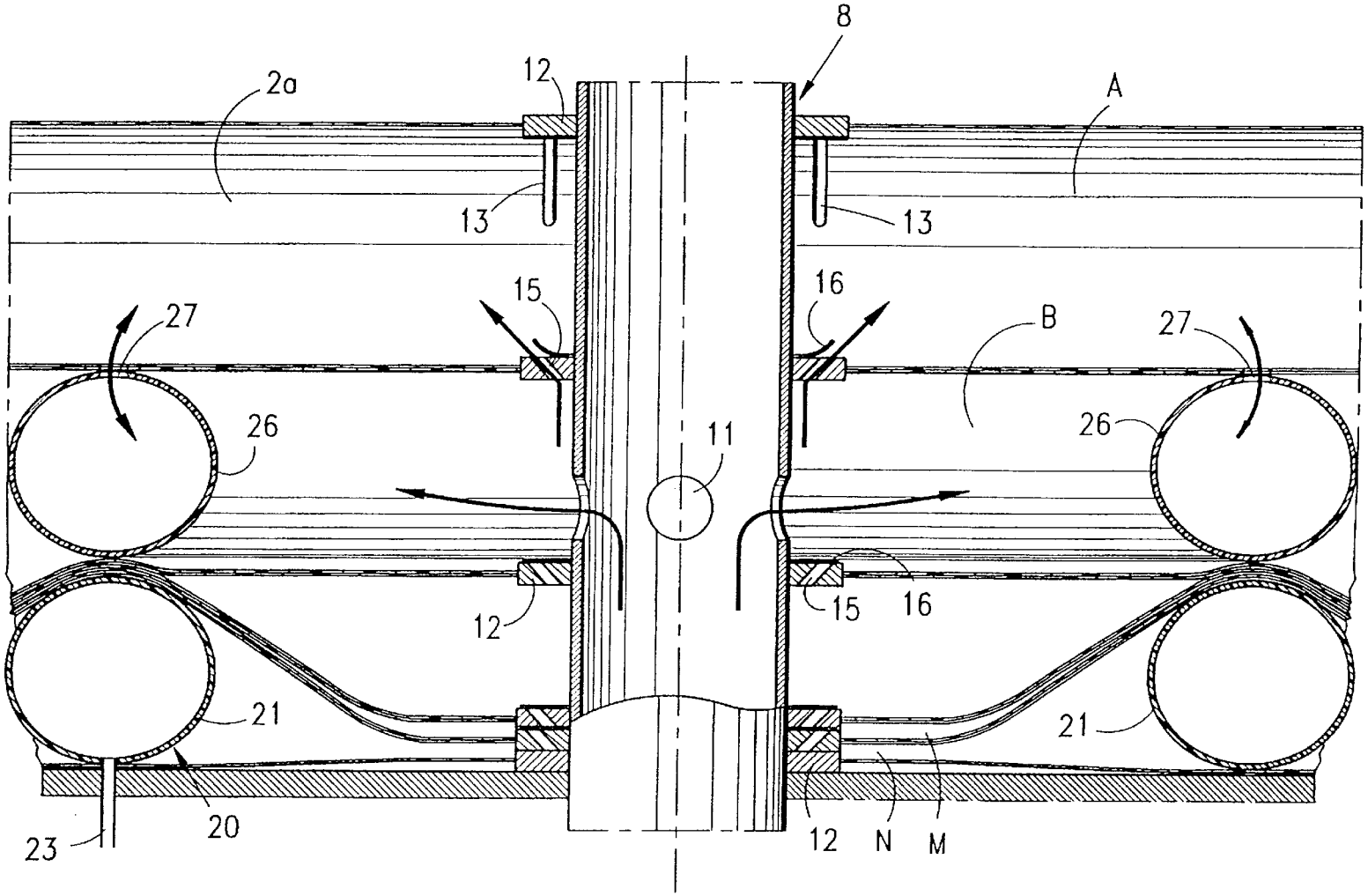
FIG. 5 is a diagrammatic view in transverse section showing a variant of the means for successive positioning of the inner space of each inflatable beam.

According to a variant shown in FIG. 5, the means for successive positioning of the inner space 2*a* of each inflatable beam A, B, C . . . opposite the orifice 11 of the rigid beam 8 also comprise at least one auxiliary wedge 26 arranged in the inner space 2*a* of at least one inflatable beam A, B, C . . . and in the vicinity of the rigid beam 8.

Preferably, the auxiliary wedge 26 is positioned above the wedge 21.

In the illustrative embodiment shown in FIG. 5, the auxiliary wedge 26 is arranged in the inner space 2*a* of the inflatable beam B contiguous with the upper inflatable beam A.

The auxiliary wedge 26 may be arranged in the inner space 2*a* of another inflatable beam A, B, C . . . or in the inner space 2*a* of each of the inflatable beams.

The auxiliary wedge 26 is formed by an inflatable cushion, which can be retracted by deflation, communicating with the inner space 2*a* of the inflatable beam located above, via an orifice 27.

The inflatable cushions forming the wedge 21 or the auxiliary wedge 26 preferably have an oblong cross section and are formed by a coated fabric of two layers woven together using the same threads and joined by a multitude of thread strands of the same length common to the two layers.

According to further variants, the positioning means 20 may include only the wedges 21 or the wedges 26 or, alternatively, the two wedges 21 and 26 arranged one on top of the other so as to compensate for the deformation of the beams A, B, C . . .

Figure 6:
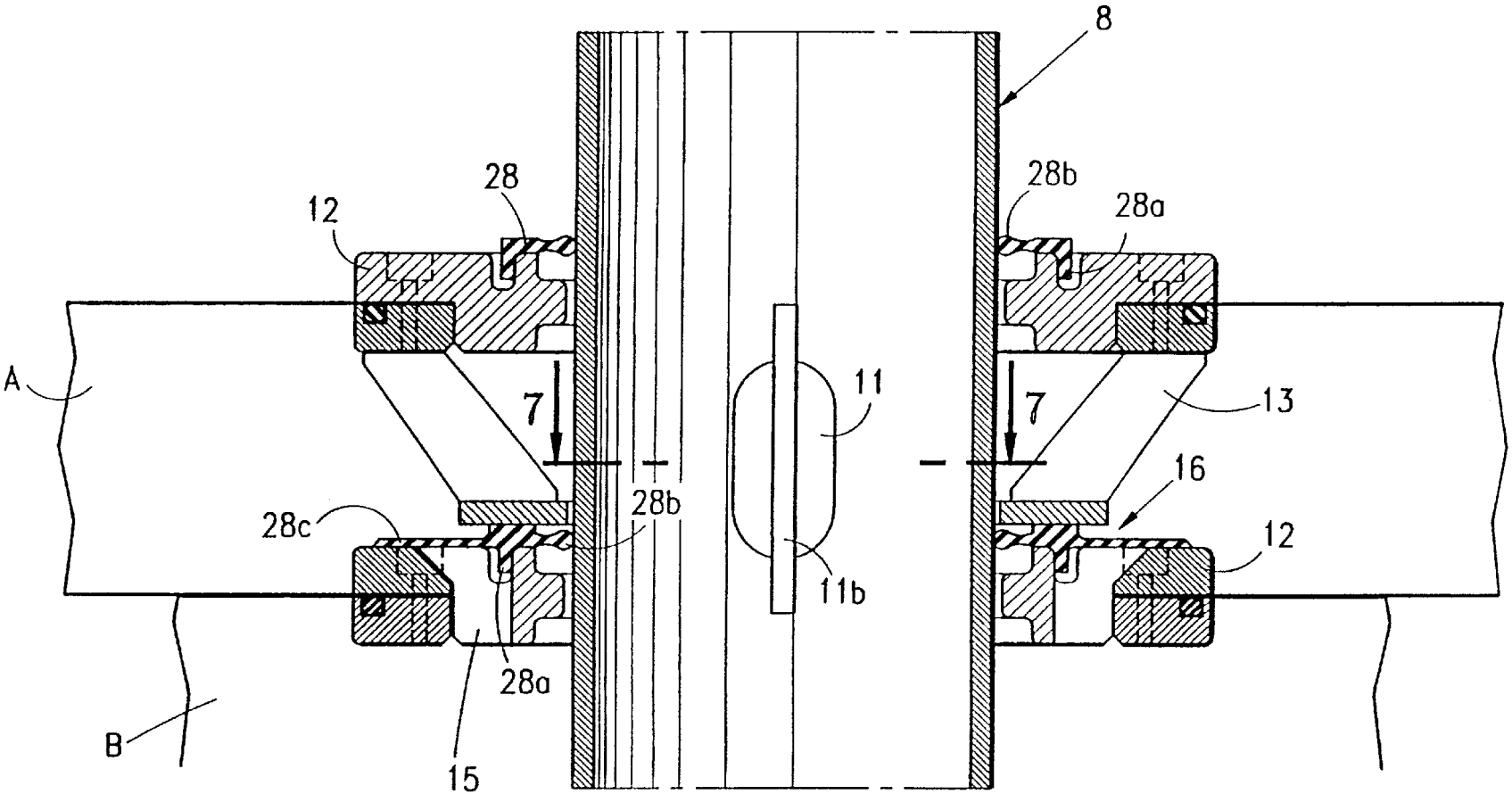
FIG. 6 is a view in transverse section showing the leaktight linking means of the adjacent walls of an inflatable beam.

As shown in FIG. 6, the means for leaktight linking of the adjacent walls of the inflatable beams A, B, C . . . comprise a leaktight seal 28, one end 28*a* of which is fastened to the corresponding plate 12 and the other end 28*b* of which bears slidably around the rigid beam 8.

If the leaktight seal 28 is arranged on a plate 12 equipped with a communication orifice 15, this leaktight seal 28 includes a flexible membrane 28*c* which forms the non-return valve 16 for closing off the orifice 15.

The leaktight seal 28 and the membrane 28*c* are produced as a single component moulded from elastomere.

Figure 7:
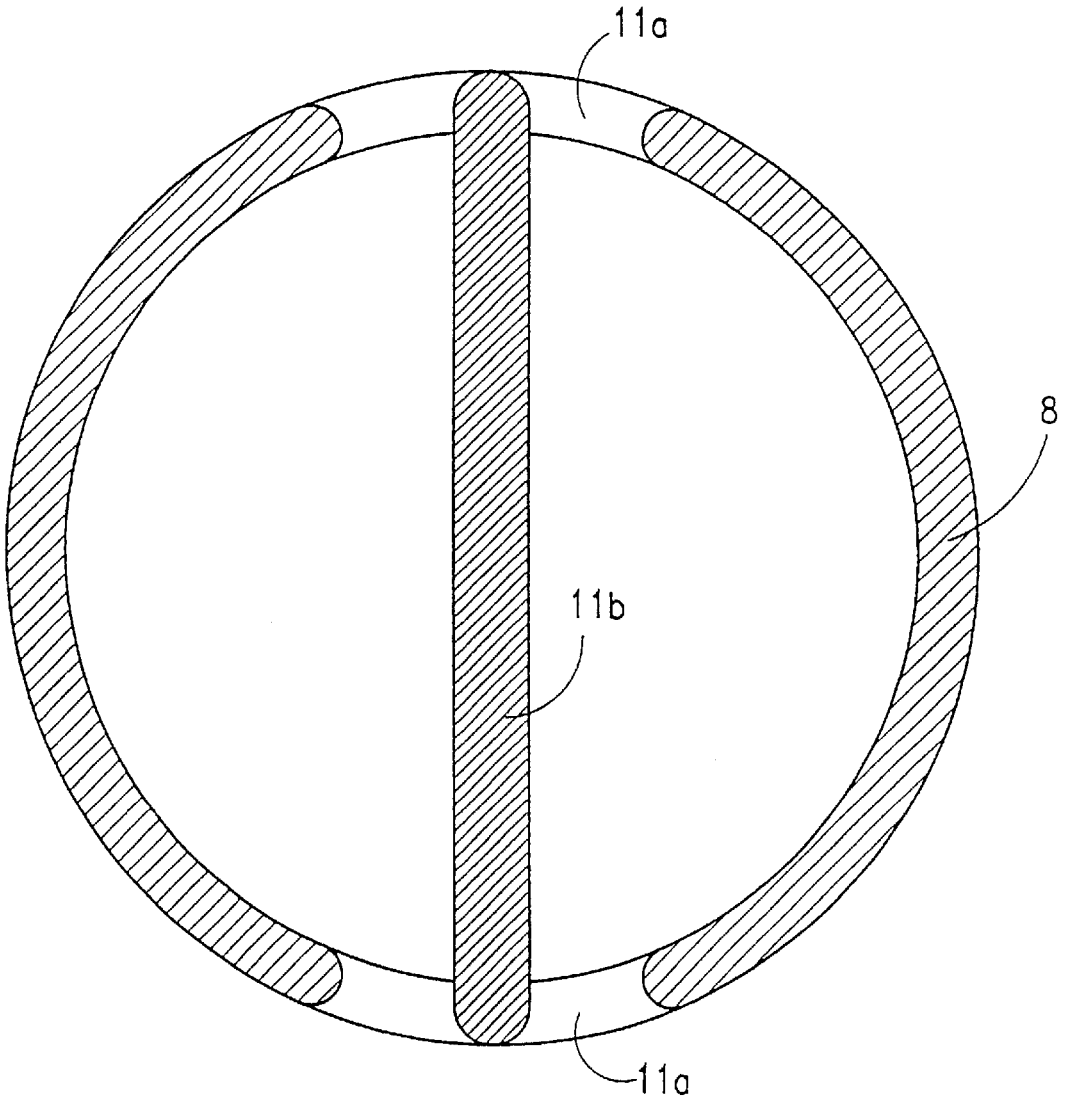
FIG. 7 is a sectional view along the line 7—7 in FIG. 6.

The rigid beam 8 is formed by a cylindrical tube and the orifice 11 made in its wall preferably includes two diametrically opposed openings 11*a*, as shown in FIG. 7.

The openings 11*a* are equipped, substantially in their central part, with a transverse reinforcement plate 11*b* which is substantially parallel to the axis of the tube forming the rigid beam 8.

Figure 8:
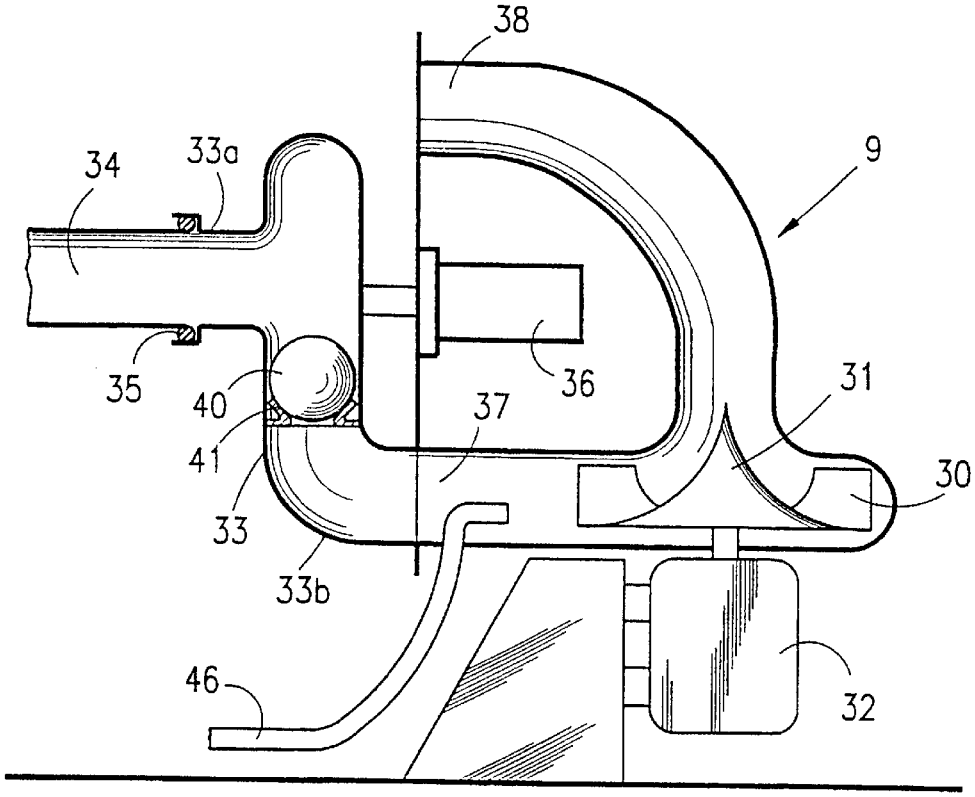
FIGS. 8 and 9 are diagrammatic views in transverse section of the means for supplying the inflatable beams with pressurized fluid.
Figure 9:
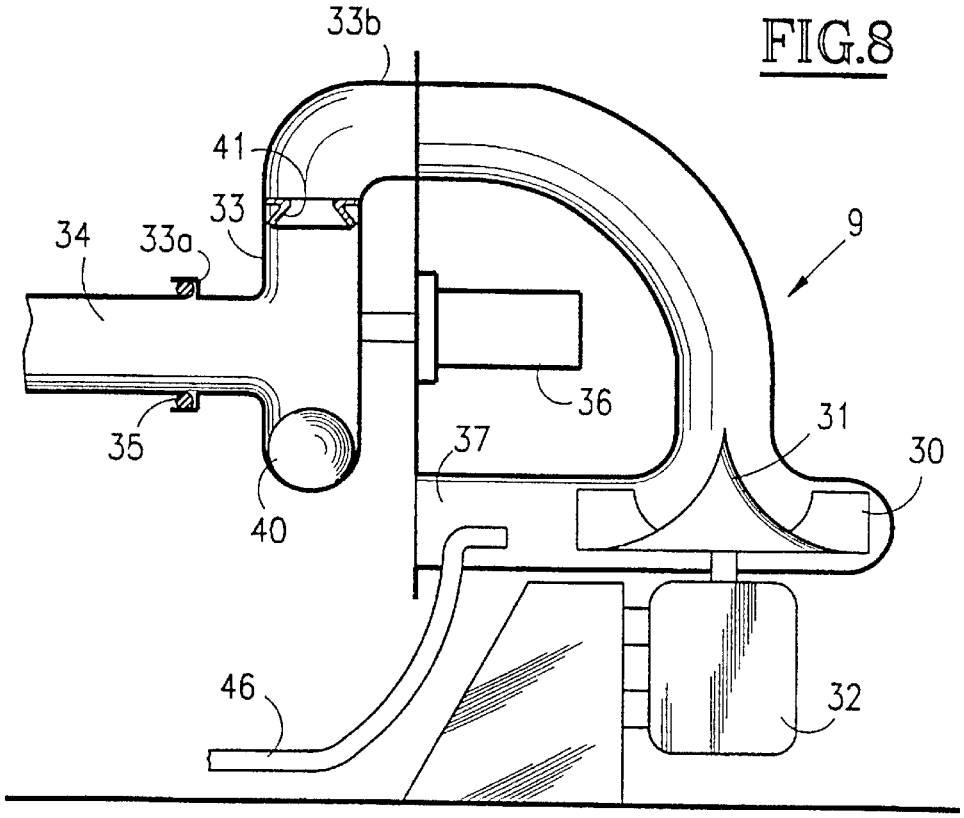

With reference, now, to FIGS. 8 and 9, a description will be given of the pressurized-fluid-supply means 9.

These pressurized-fluid-supply means 9 are formed by a turbo exhauster 30 including a roller 31 driven in rotation by a motor 32 and whose axis of rotation is, for example, arranged substantially vertically.

The turbo exhauster 30 also includes a member for reversing the direction of flow of the fluid formed by an S-bend hose 33.

This hose 33 includes a first end 33*a* mounted pivotedly on a conduit 34 for linking with the rigid beam 8 via a revolving joint 35.

The bent hose 33 is displaceable by means, for example, of a motor 36 between a first low position (FIG. 8) in which the second end 33*b* of the hose 33 is located opposite a delivery orifice 37 of the exhauster 30 and a high position (FIG. 9) in which the second end 33*b* is located opposite an aspiration orifice 38 of this exhauster 30.

The bent hose 33 is equipped on the inside with a non-return valve 40 which is displaceable by means of gravity.

This non-return valve 40 consists, for example, of a ball which is displaceable between a first position (FIG. 8) in which the valve 40 rests on a seat 41 made inside the bent hose 33 and a second position (FIG. 9) in which the valve 40 is separated from the seat 41.

The first position of the valve 40 corresponds to that position of the bent hose 33 in which the end 33*b* is opposite the delivery orifice 37 of the exhauster 30 and the second position of the valve 40 corresponds to the high position of the bent hose 33 in which the end 33*b* of this hose 33 is located opposite the suction orifice 38 of this exhauster 30.

In this second position, gravity prevents closure of the valve 40 over the seat 41.

Figure 10:
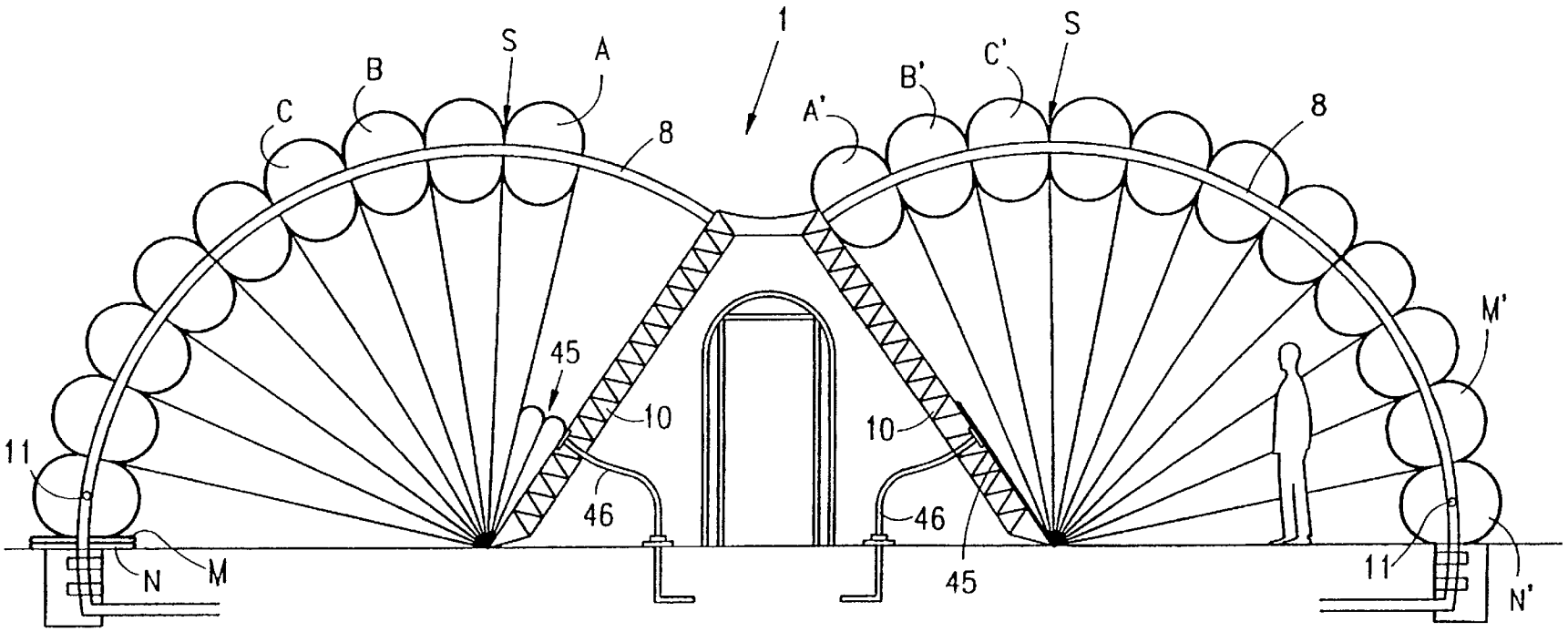
FIG. 10 is a diagrammatic view in transverse section of a second embodiment of a deployable and retractable canopy according to the invention.

In the embodiment shown in FIG. 10, the inflatable canopy, designated overall by the reference 1, is formed from two series of inflatable beams A, B, C . . . and A', B', C' . . . , respectively.

Each series of inflatable beams is identical to that of the preceding embodiments.

As shown in FIG. 10, some of the inflatable beams A, B, C . . . and some of the inflatable beams A', B', C' . . . go beyond the summit position S of the corresponding rigid beam 8 when each series of inflatable beams is in the deployed state.

Thus, during their displacement, the inflatable beams A, B, C . . . and A', B', C' . . . initially follow an ascending movement as far as this summit position S and then a descending movement beyond this position in order to close the canopy 1.

To assist opening of each series of inflatable beams in opposition to gravity, the canopy includes at least one cushion 45 for lifting the upper beam A or A' during refolding of each series of inflatable beams A, B, C . . . and A', B', C' . . .

The cushion 45 is inflatable and retractable by deflation an connected directly and permanently via a flexible hose 46 to the delivery orifice 37 of the turbo exhauster 30.

The lifting cushion 45 is preferably arranged between at least one of the ends of the upper inflatable beam A or A' and the corresponding bearing element 10.

According to a variant, the lifting cushion 45 may be arranged at the level of the rigid beam 8 and, in this case, the rigid beam 8 may pass through it.

According to a further variant, each of the lifting cushions 45 has one end fastened to the same foundation or ballasting means 7, connected to the ground, as the ends of the inflatable beams A, B, C . . .

Figure 12:
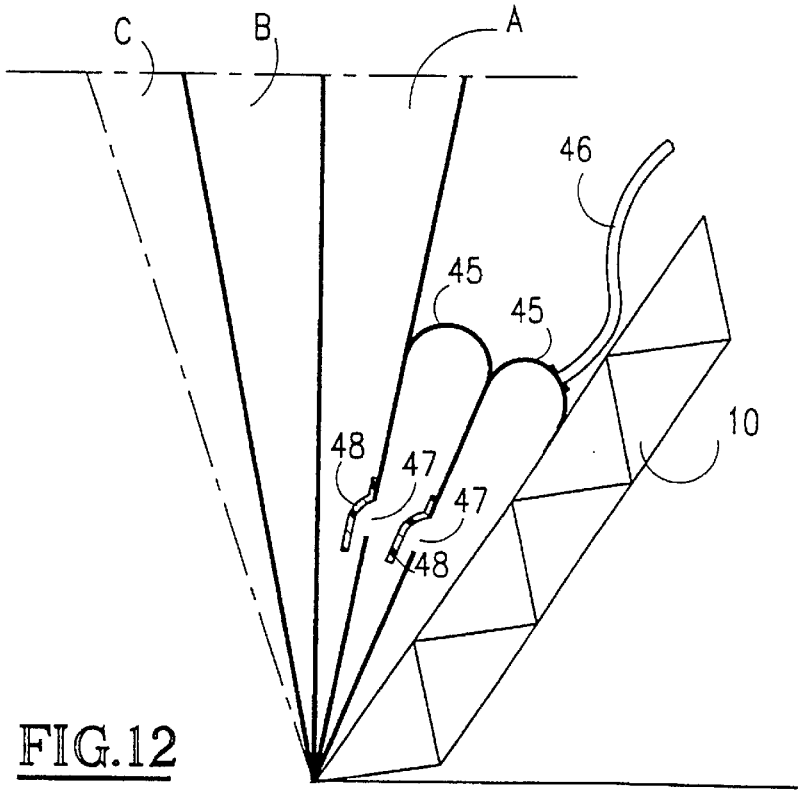
FIG. 12 is a diagrammatic view in transverse section showing the lifting cushions of the upper beam during refolding of the canopy.

In the embodiment shown in FIGS. 10 and 12, the lifting cushion 45 is formed by a plurality of superposed cushions 45 connected to one another and to the upper beam A or A' via orifices 47 which are each equipped with a non-return valve 48 providing the passage for the fluid from the lower lifting cushion 45 towards the other lifting cushions and the upper inflatable beam A or A'.

The lower lifting cushion 45 is connected directly and permanently to the delivery orifice 37 of the exhauster 30 via the flexible hose 46.

Figure 11:
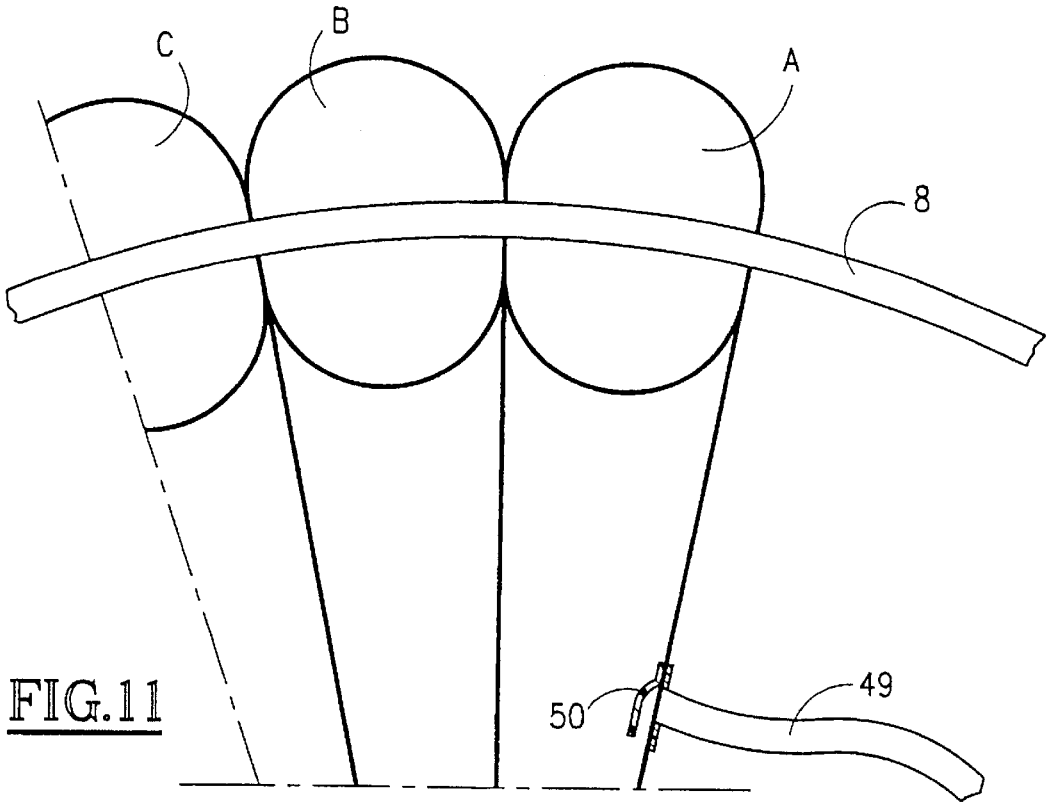
FIG. 11 is a diagrammatic view showing the link between the supply means and the upper inflatable beam.

According to a particular embodiment shown in FIG. 11, the upper beam A of the inflatable canopy 1 is connected directly and permanently to the delivery orifice 37 of the exhauster 30 via a flexible hose 49 whose end opens up into the upper beam A and is equipped with a non-return valve 50.

Figure 13:
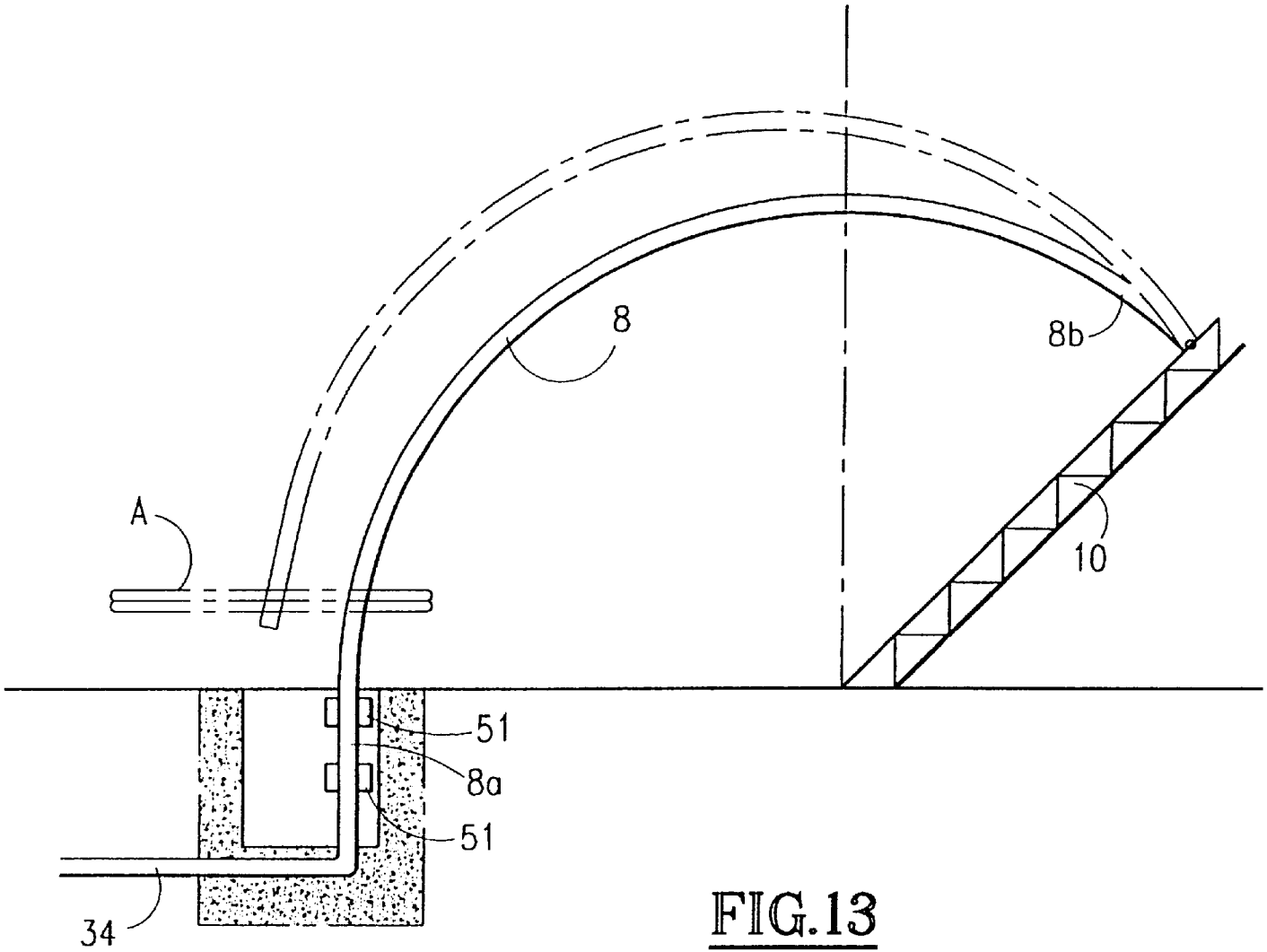
FIG. 13 is a diagrammatic view in transverse section showing a third embodiment of a deployable and retractable canopy according to the invention.

According to an embodiment shown in FIG. 13, the rigid beam 8 which is formed by a curved beam is fastened at one of its ends 8*a* via a dismantlable mechanical link 51 to a stationary support, whilst its upper end 8*b* is mounted in an articulated manner so as to pivot, for example, on the corresponding bearing element 10.

During assembly of the canopy 1, the rigid beam 8 is tilted about its end 8*b* and the inflatable beams A, B, C . . . are flipped over the end 8*a* of the rigid beam 8, as shown in broken lines in FIG. 13.

Next, the rigid beam 8 is tilted in the opposite direction and its end 8*a* is fastened via the mechanical link 51.

Figure 14:
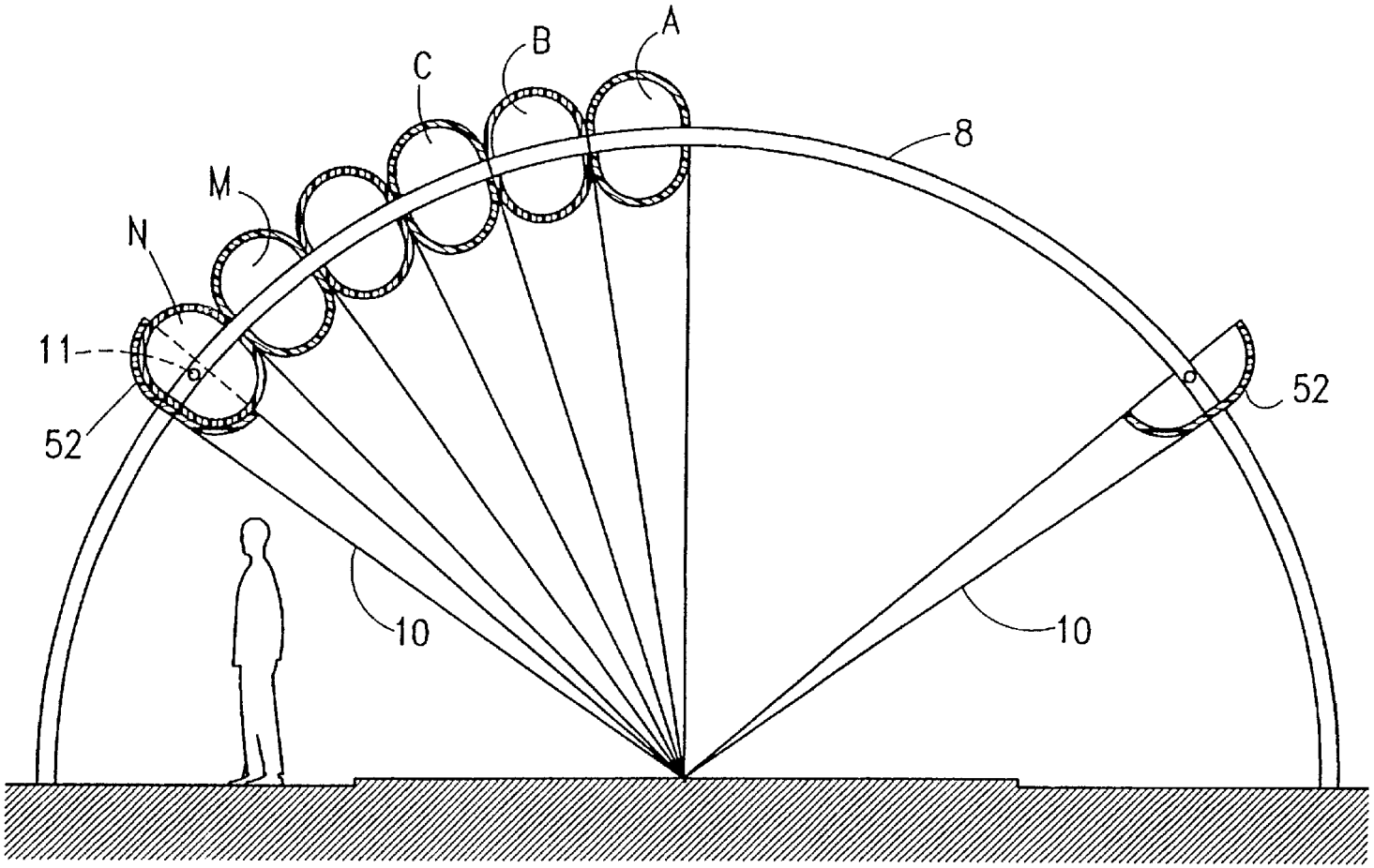
FIG. 14 is a diagrammatic view in transverse section showing a fourth embodiment of a deployable and retractable canopy according to the invention.

According to a last embodiment shown in FIG. 14, the bearing elements 10 have the shape of a trough 52 whose concave face matches the shape of the lower half of the inflatable beam with which it is in contact.

In the case of two symmetrical series of inflatable beams, each trough 52 forms a receptacle for receiving the beams A, B, C . . . in the deflated state.

The canopy 1 is deployed as follows:

As shown in FIGS. 3 and 8, in the folded state, the beams A, B, C . . . are deflated and bear on one another and the end 33*b* of the bent hose 33 is arranged opposite the delivery orifice 37 of the exhauster 30.

In this position, the inner space 2*a* of the upper beam A is arranged opposite the orifice 11 by virtue of the spacers 13 for separating the lateral walls 3 and 4 from the upper beam A.

The exhauster 30 is switched on and the pressurized air penetrates, via the rigid beam 8 and the orifice 11 into the inner space 2*a* of the upper beam A which inflates at the same time as the cushions 21 via conduits 23 and 24 and the three-way valve 22 which places these conduits 23 and 24 in communication.

The upper beam A is deployed and rigidified, assuming the configuration shown in FIG. 4 and bearing on the cushions 21.

The orifice 11 made in the rigid beam 8 is then located opposite the inner space 2*a* of the beam B which, in turn, inflates through the effect of the pressurized air.

Next, the other beams C . . . M, N are inflated one after the other in the same way and, when these beams have been inflated, the orifice 11 is opposite the inner space 2*a* of the lower beam N.

Thus, all the inflatable beams A, B, C . . . of the canopy 1 are inflated and this canopy is deployed.

If, during or after this deployment, the beams A, B, C . . . and M rise too rapidly and are not completely inflated to the required pressure, their pressurization is continued from the lower beam N via the orifices 15 made in the plates 12, the valves 16 opening automatically through the effect of the fluid pressure.

For a canopy 1 including a significant number of inflatable beams A, B, C . . . , the cumulative weight of these beams combined with their flexibility may give rise to the phenomenon of the bearing forces on the cushions 21 not allowing their displacement above the orifice 11, so that deployment of the canopy 1 is interrupted.

To prevent this interruption and to allow full deployment of the canopy 1, the auxiliary cushions 26 which communicate with the beam located above that in which these auxiliary cushions 26 are installed (FIG. 5) are inflated and provide the necessary complementary wedging to complete deployment of the entire canopy 1.

Once the completed canopy 1 has been deployed, the exhauster 30 is stopped and the valve 40 closes automatically, thereby isolating all the beams A, B, C . . . of the canopy 1.

If, owing to various leaks, the pressure inside the beams A, B, C . . . drops slightly and has to be re-established, the exhauster 30 which has remained in the inflation configuration shown in FIG. 8 is switched on again.

The air is blown into the lower beam N and then into the orifices 15 successively in the beams M . . . C, B, A.

The valves 16 open automatically when the pressure in the lower beam N is greater than that in the beam located above, and so on.

The beams A, B, C . . . of the canopy 1 are refolded as follows.

Firstly, the motor 36 controlling the pivoting of the bent hose 33 is switched on, which causes this bent hose 33 to rotate about its end 33*a* so as to position the end 33*b* opposite the suction orifice 38 of the exhauster 30, as shown in FIG. 9.

In this position, the ball forming the valve 40 falls under gravity into the bottom of the bent hose 33 and this valve 40 can no longer come into contact again with its seat 41, so that the air can freely be aspirated from the lower beam N via the orifice 11, the rigid beam 8 and the conduit 34.

As the three-way valve 22 is held in the position in which it places the cushions 21 in communication with the exhauster 30, the beam N progressively deflates at the same time as the cushions 21.

The beams M . . . , C, B and A arranged above the lower beam N lose their support on this lower beam N and on the cushions 21, with the result that these beams descend under gravity and are deflated one after the other when each inner space 2*a* of the beams M . . . , C, B and A arrives opposite the orifice 11.

As each inner space 2*a* of these beams is not opposite the orifice 11, each beam remains completely inflated, given that the valves 16 close automatically and prevent the passage of fluid between these beams.

The non-deflated part of the canopy retains its rigidity and can therefore pivot as a whole while continuing, for example, to withstand gusts of wind or to support snow.

With a view to improving this rigidity of the non-deflated beam during retraction, the upper beam A may be permanently supplied during this retraction by means of the flexible hose 46 connected to the delivery orifice 37 of the exhauster 30.

If the inner spaces 2*a* of the beams A, B, C . . . have descended below the orifice 11 prior to being completely deflated, these beams may continue their deflation via the orifices 15, the reduction in pressure engendered by the aspiration of the exhauster 30 opening the valves 16.

In the case of a canopy whose deployment goes beyond the summit position of the rigid beam 8, as shown, for example, in FIG. 10, the lifting cushions 45 are inflated in order to assist retraction of the beams of the canopy.

To this end, the same exhauster 30 is used and this exhauster 30 simultaneously deflates the beams by means of its aspiration orifice 38 and inflates the lifting cushions 45 which are in communication with the delivery orifice 37 of the exhauster 30 via the hose 46.

In certain cases, it is advantageous to be able to deploy the canopy 1 partially, for example in order to protect oneself from the wind while taking advantage of the sun.

To this end, the exhaust 30 is stopped when, for example, the first three beams A, B, C are inflated.

The valve 40 closes automatically on its seat 41 and isolates these three beams.

After a certain period, owing to various leaks, the pressure in these beams drops slightly and they have to be reflated.

If the installation remains as it is, reinflation gives rise not only to the reinflation of these three beams but also, automatically, to the deployment of the other beams, in order to fully close the canopy.

To prevent this, the three-way valve 22 is tilted into the position in which it places the cushions 21 in communication with the open air.

The beams A, B, C previously deployed thus no longer bear on these cushions 21, which are retracted by deflation, and can no longer be raised in order to bring the orifice 11 opposite the inner space of the next beam and deployment is halted.

Switching the exhauster 30 on again therefore has the effect only of re-establishing the required pressure in the beams A, B and C which were previously deployed.

Figure 15:
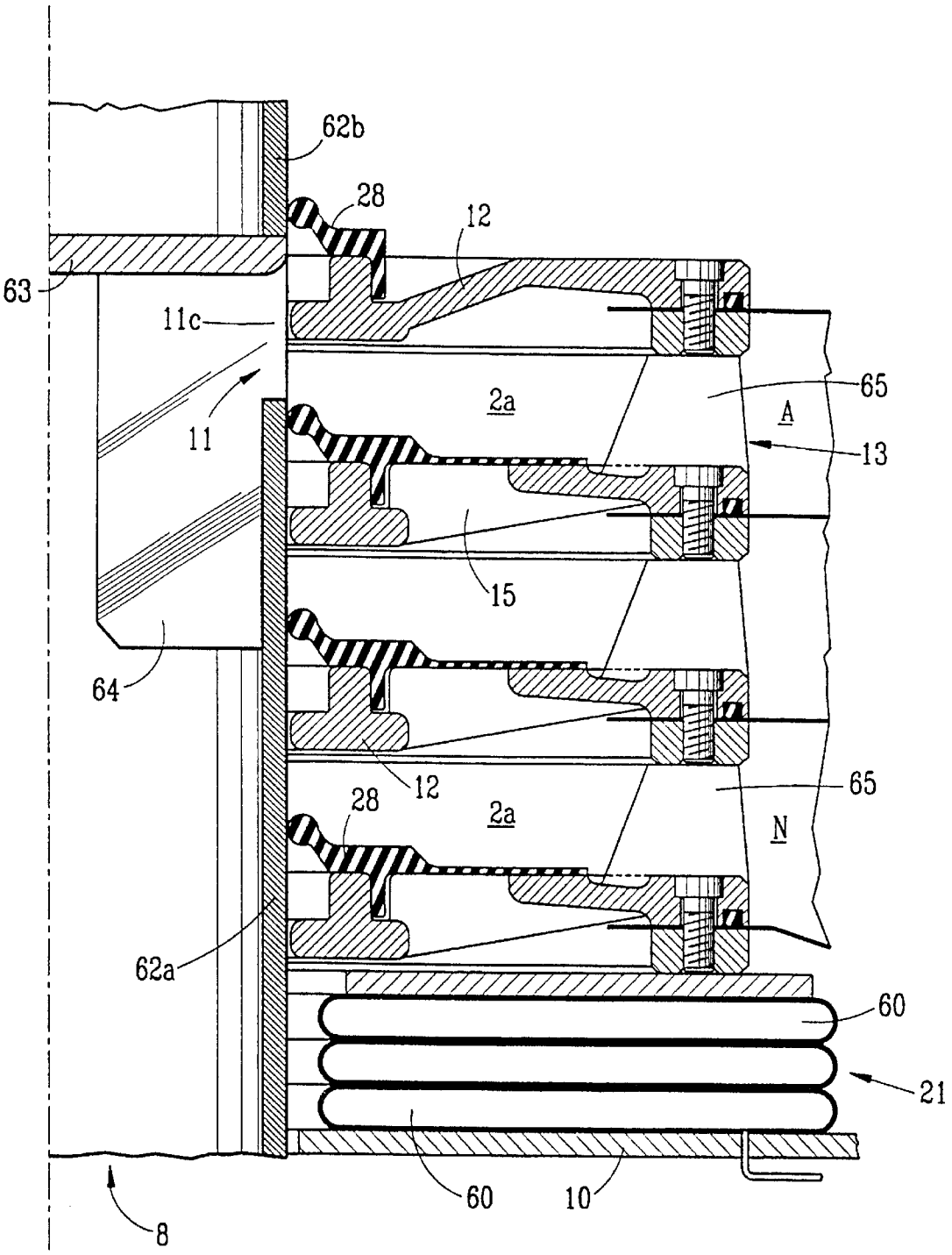
FIG. 15 is a diagrammatic half-view in transverse section of a variant of the means for successive positioning of the inner space of each inflatable beam.
Figure 16:
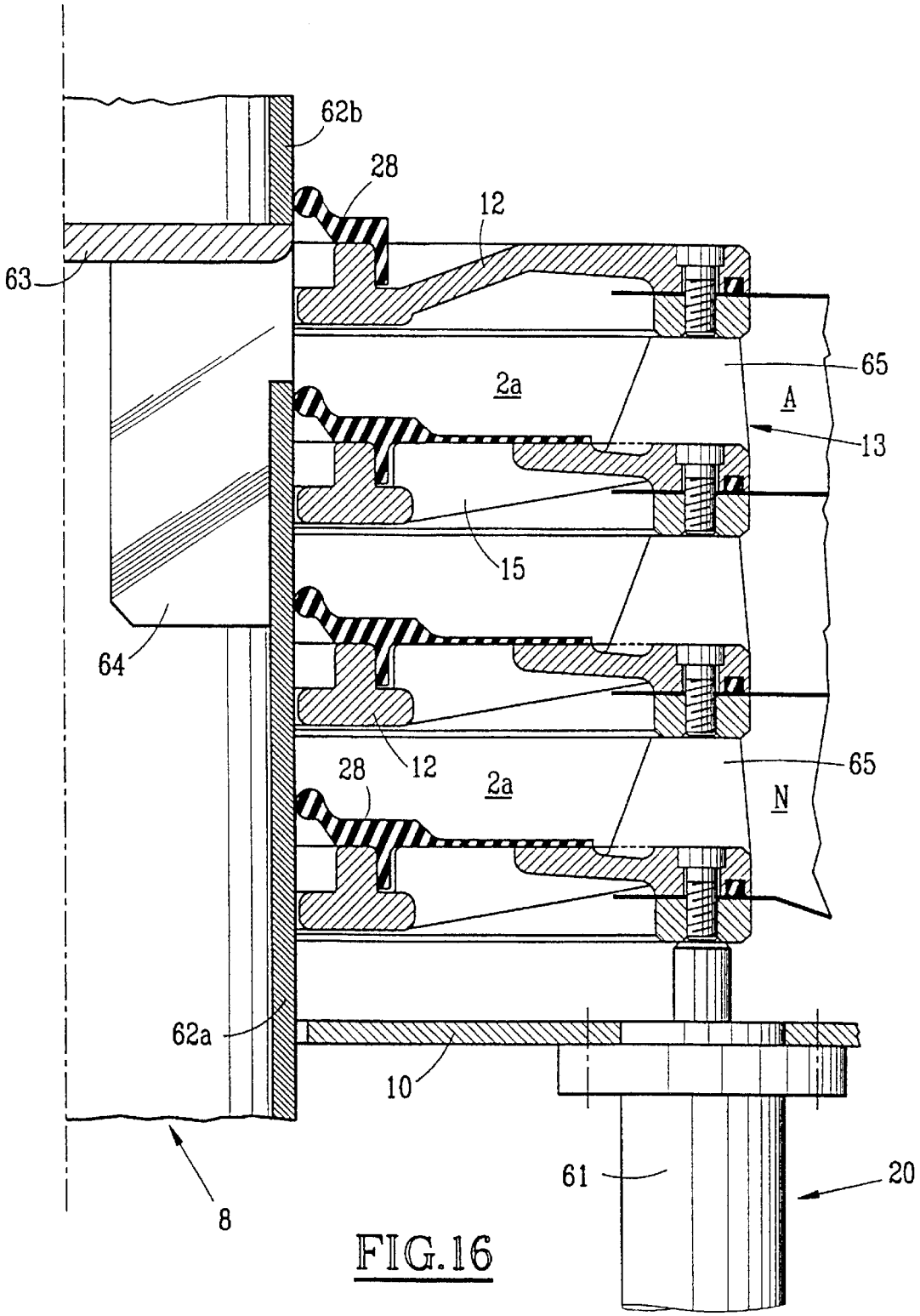
FIG. 16 is a diagrammatic half-view in transverse section of a further variant of the means for successive positioning of the inner space of each inflatable beam.

FIGS. 15 and 16 show two variants of the means 20 for successive positioning of the inner space 2*a* of each inflatable beam A, B, C . . . opposite the orifice 11 made in the rigid beam 8.

According to the embodiment shown in FIG. 15, the wedge 21 associated with the stacking of the inflatable beams A, B, C . . . and arranged in the vicinity of the rigid beam 8 is formed by the superposition of inflatable cushions 60 which can be retracted by deflation.

These cushions 60 are interposed between the plate 12 for leaktight linking of the inner wall of the beam N and the first bearing element 10.

Moreover, each cushion 60 is linked separately via a valve (not shown) to a pressurized-fluid-supply source.

According to a further variant shown in FIG. 16, the means 20 for successive positioning of the inner space 2*a* of each inflatable beam A, B, C . . . opposite the orifice 11 are formed by at least one ram 61 arranged between the lower beam N and the corresponding bearing element 10 and below the plate 12 for leaktight linking of the lower wall of the beam N around the rigid beam 8 and the bearing element 10 of the inflatable beams A, B, C . . . in the deflated state.

When the canopy 1 is retracted, the inflatable beams A, B, C . . . N are deflated and the plates 12 are stacked on one another.

In these embodiments, the inflatable beams A, B, C . . . include, around the rigid beam 8, means 13 for separating the walls of each of the inflatable beams.

These separation means 13 consist of spacers 65 which are fastened to the upper face of each plate 12 and make it possible to separate the upper and lower walls of each beam by a height which is substantially equal to that of the orifice 11.

In the deflated state of the beams A, B, C . . . , the orifice 11 is therefore located opposite the inner space 2*a* of the beam A and the latter may be inflated by the pressurized fluid blown into the rigid beam 8.

In the case of inflatable cushions 60 which can be flattened by deflation, successive inflation of these cushions 60 separately, with the aid of a pressurized-fluid source which may be the principal source serving to supply the inflatable beams A, B, C . . . with pressurized fluid or an additional source at a higher pressure than the principal source, gives rise to a translation of the stack of plates 12 by the height necessary to bring the spaces 2*a* of the beams B, C . . . N opposite the orifice 11.

If the positioning means 20 consist of a ram 61, for example an electric ram actuated by a stepping motor, the total travel of this ram 61 is equal to the translation travel necessary to bring the spaces 2*a* of the beams B, C . . . N successively opposite the orifice 11.

According to a variant shown in FIGS. 15 and 16, the rigid beam 8 is formed by a cylindrical tube and the orifice 11 made in its wall is formed by an aperture 11*c* separating the tube into two sections 62*a* and 62*b*, respectively.

The first section 62*a* is connected to the pressurized-fluid-supply means 9 for successively inflating the beams A, B, C . . . and the second section 62*b* is closed off by a plate 63 arranged above the aperture 11*b* and connected to the first section 62*a* via radial ribs 64.

These radial ribs 64 also make it possible to channel the pressurized fluid into the inner space 2*a* of the inflatable beam placed opposite the aperture 11*c*.

Figure 17:
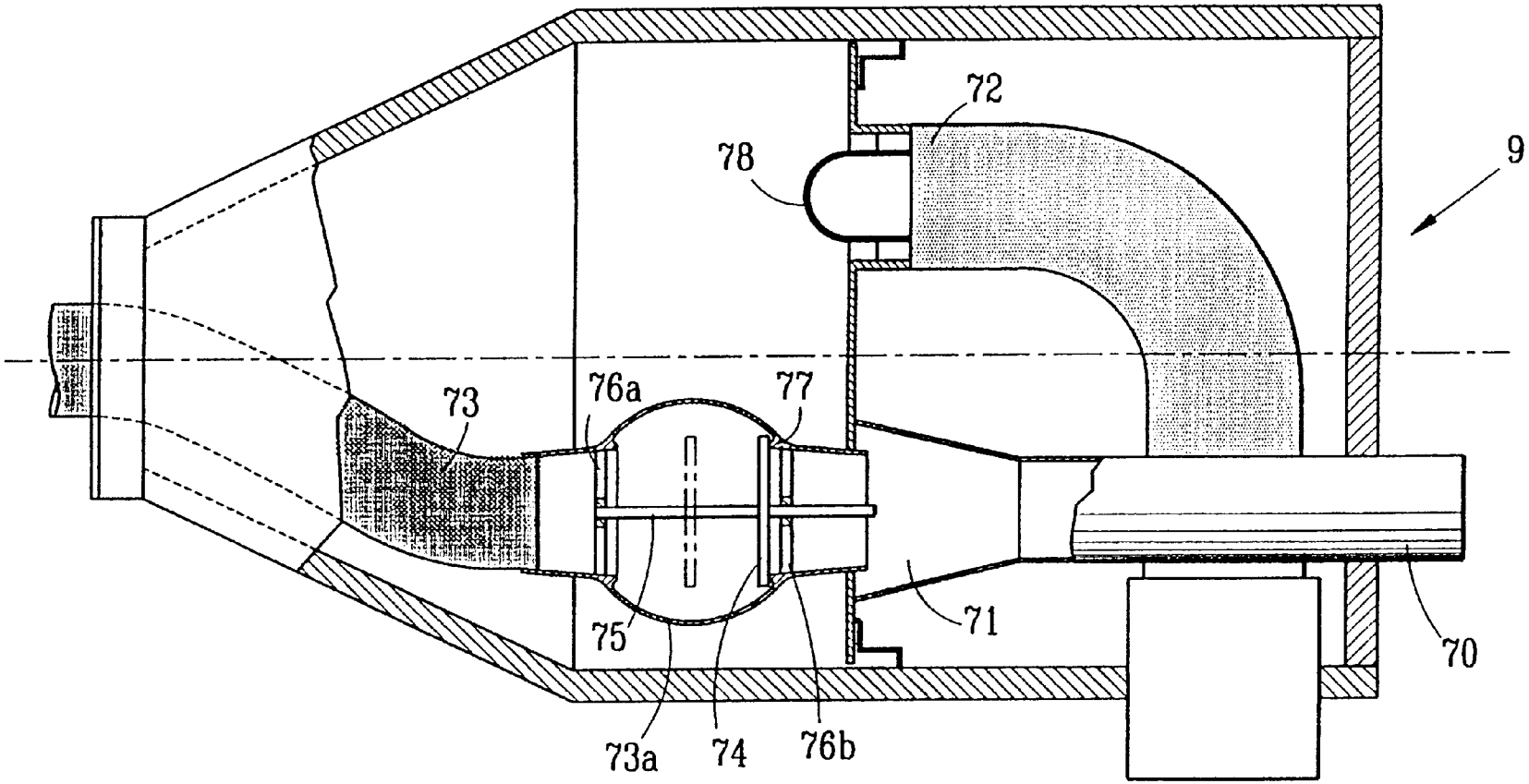
FIGS. 17 and 18 are diagrammatic views in transverse section of a variant of the means for supplying the inflatable beams with pressurized fluid.
Figure 18:
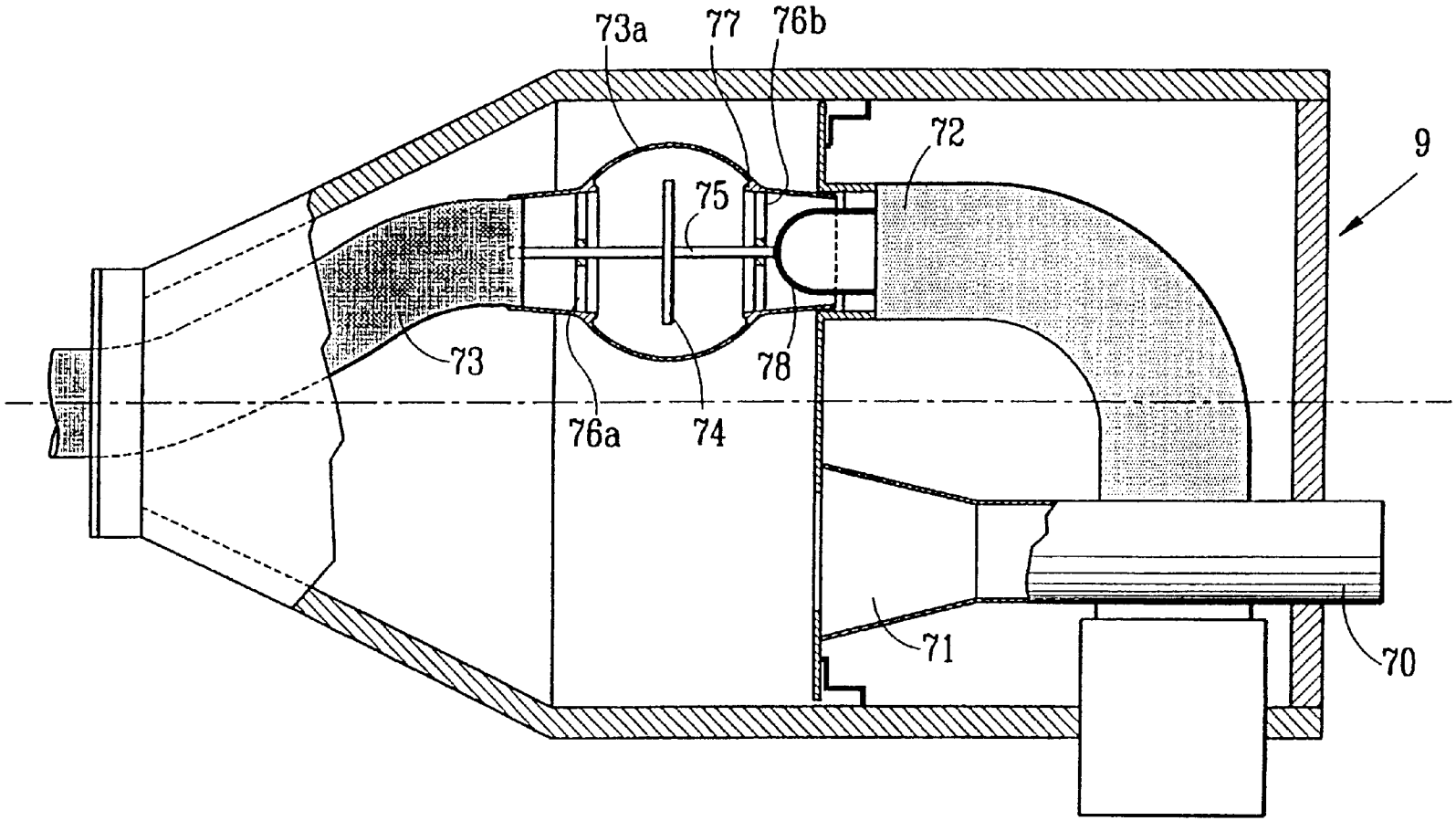

With reference, now, to FIGS. 17 and 18, a description will be given of a variant of the means 9 for supplying the inflatable beams A, B, C . . . with pressurized fluid.

In this embodiment, the pressurized-fluid-supply means 9 are formed by an exhauster 70 including a delivery orifice 71 and an aspiration orifice 72 and by a member for reversing the direction of flow of the fluid, formed by a hose 73 at whose end an end-piece 73*a* is mounted for connection to one of the orifices 71 or 72 with the aid of appropriate linking means.

The hose 73, preferably produced from a flexible material, includes a non-return valve 74 integral with a rod 75 mounted slidably on two opposite supports 76*a* and 76*b* fastened inside the end-piece 73*a* of the hose 73.

These supports 76*a* and 76*b* consist of radial spacers which, between them, form passages for the circulation of the pressurized fluid.

The non-return valve 74 is displaceable between an open position which allows the circulation of the fluid and in which it is distant from a valve seat 77 made in the end-piece 73*a* and a closed position in which it rests against the valve seat 77 to prevent the circulation of pressurized fluid.

In the open position, i.e. during inflation of the beams A, B, C . . . , the non-return valve 77 bears against the support 76*a*.

If the hose 73 is connected to the orifice 71 for delivery of pressurized fluid, the non-return valve 74 is in the open position during inflation of the beams A, B, C . . . , as shown in broken lines in FIG. 17, or in the closed position, resting against the valve seat 77 by means of the counterpressure after the inflation of these beams A, B and C . . . , as shown in solid lines in FIG. 17.

To deflate the beams A, B, C . . . with a view to retracting the canopy 1, the hose 73 is connected to the suction orifice 72, as shown in FIG. 18.

The normal direction of flow of the fluid aspirated by the exhauster 70 should keep the non-return valve 74 resting against the valve seat 77.

However, to prevent closure of the non-return valve 74 and to allow deflation of the beams A, B, C . . . , this non-return valve 74 is kept in the open position by means of a stop 78 mounted on the suction orifice 72 and on which the end of the rod 75 bears, as shown in FIG. 18.

By virtue of this arrangement, the fluid aspirated by the exhauster 70 flows into the hose 73 and into the suction orifice 72.

Figure 19:
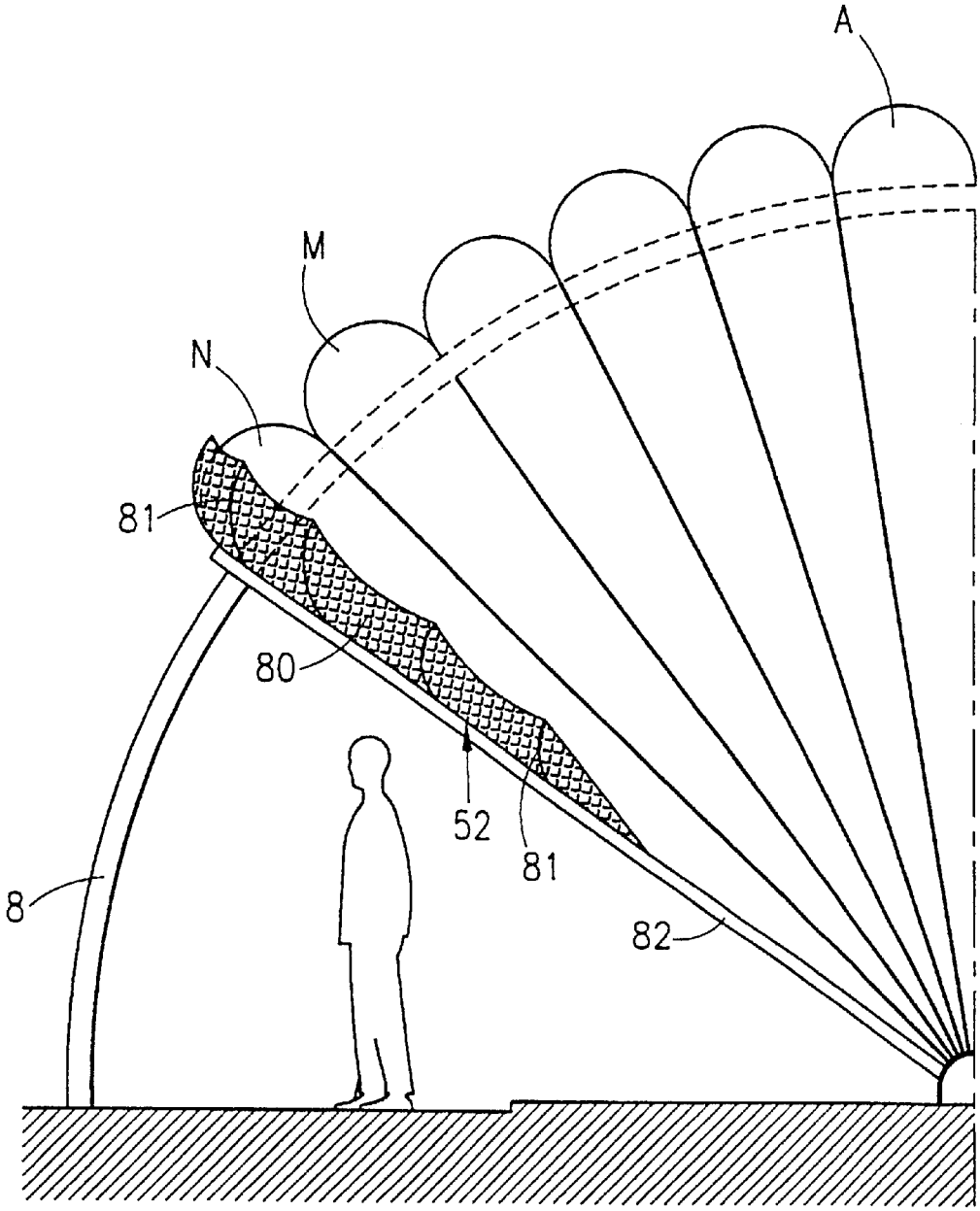
FIG. 19 is a partial diagrammatic view of a variant of a bearing element of the beams.

According to a particular embodiment shown in FIG. 19, each bearing element 52 in the shape of a trough consists of stretched fabric 80 bearing on a series of arches 81 carried by at least one beam 82 extending parallel to the inflatable beams A, B, C . . . .

Finally, at least one of the bearing elements 10 of the inflatable beams A, B, C . . . may extend only over part of the length of the beams.

What is claimed is:

1. A canopy, which can be inflated and deployed by inflation, and retracted by deflation, said canopy comprising:

a plurality of inflatable beams arranged side by side, said inflatable beams each having an inner space and walls, said plurality including an upper inflatable beam and a lower inflatable beam;

a pressurized-fluid-supplier operable to supply said inflatable beams with pressurized fluid;

a rigid beam having a wall;

sliding means for sliding said inflatable beams along at least one deployment or refolding path formed by said rigid beam passing, in a leaktight manner, through said inflatable beams and forming a fluid-conveying channel linked to said pressurized-fluid supplier;

at least one orifice in said wall of said rigid beam, placing said pressurized-fluid supplier in communication with said inner space of said inflatable beams;

linking means for leaktight linking of adjacent walls of said inflatable beams around said rigid beam;

spacing means, around said rigid beam, for spacing said walls of said upper inflatable beam from one another;

at least one bearing element bearing against said inflatable beams; and positioning means for successive positioning of said inner space of each inflatable beam, said positioning means being opposite said orifice of said rigid beam to guarantee inflation of said inflatable beams, by the pressurized fluid, from said upper inflatable beam to said lower inflatable beam and deflation of said inflatable beams from said lower inflatable beam to said upper inflatable beam.

2. The canopy according to claim 1, wherein said positioning means is actuated automatically by a flow of the pressurized fluid.

3. The canopy according to claim 1, wherein said orifice of said rigid beam is located opposite said inner space of said upper inflatable beam during a deflated state of said inflatable beams and opposite said inner space of said lower inflatable beam during an inflated state of said inflatable beams.

4. The canopy according to claim 1, wherein said positioning means comprises at least one wedge associated with a stacking of said inflatable beams and arranged in a vicinity of said rigid beam.

5. The canopy according to claim 4, wherein said wedge is arranged between said lower inflatable beam and said bearing element during the deflated state.

6. The canopy according to claim 4, wherein said wedge is arranged inside said lower inflatable beam.

7. The canopy according to claim 4, comprising a further pressurized-fluid supplier, and a three-way valve, wherein said wedge comprises an inflatable cushion, which can be retracted by deflation, said three-way valve being connected to said wedge, said further pressurized-fluid supplier, and outside air, and being operable to selectively communicate said wedge with said further pressurized-fluid supplier or with the outside air.

8. The canopy according to claim 4, comprising a three-way valve, wherein said wedge comprises an inflatable cushion, which can be retracted by deflation, said three-way valve being connected to said wedge, said pressurized-fluid supplier, and outside air, and being operable to selectively communicate said wedge with said pressurized-fluid supplier or with the outside air.

9. The canopy according to claim 4, wherein said wedge comprises a superposition of inflatable cushions, which can be retracted by deflation, each inflatable cushion being connected separately, via a valve, to a pressurized-fluid-supply source.

10. The canopy according to claim 9, therein each inflatable cushion has an oblong cross section and comprises a coated fabric of two layers woven together using common threads and joined by a multitude of thread strands of a same length common to said two layers.

11. The canopy according to claim 9, wherein said inflatable beams include, around said rigid beam, spacers for separating upper and lower walls of each inflatable beam by a height substantially equal to a height of said orifice in said wall of said rigid beam.

12. The canopy according to claim 1, wherein said positioning means comprises an auxiliary wedge arranged in said inner space of at least one of said inflatable beams, other than said upper inflatable beam, and in the vicinity of said rigid beam, wherein one of said inflatable beams is located above said auxiliary wedge, said auxiliary wedge comprising an inflatable cushion, which can be retracted by deflation, communicating with said inner space said inflatable beam located above said cushion.

13. The canopy according to claim 1, wherein said positioning means comprises at least one ram arranged between said lower inflatable beam and a corresponding one of said at least one bearing element and below said linking means of said lower inflatable beam.

14. The canopy according to claim 1, comprising at least one communication orifice between two contiguous inflatable beams of said plurality of inflatable beams, said at least one communication orifice being equipped with a non-return valve arranged above said at least one communication orifice and displaceable between an open position placing said inner spaces of said contiguous inflatable beams in communication and a closed position closing off said communication orifice.

15. The canopy according to claim 14, wherein said linking means of at least some of said inflatable beams comprise a leaktight seal bearing slidably around said rigid beam, and a flexible membrane forming said non-return valve, and wherein said leaktight seal and said membrane are produced as a single component.

16. The canopy according to claim 1, wherein said rigid beam comprises a cylindrical tube, and said orifice in said wall of said rigid beam includes two diametrically opposed openings.

17. The canopy according to claim 16, wherein said openings of said orifice in said wall of said rigid beam are equipped, substantially in their center, with a transverse reinforcement plate which is substantially parallel to an axis of said cylindrical tube of said rigid beam.

18. The canopy according to claim 1, Wherein said rigid beam comprises a cylindrical tube, a plate, and radial ribs, and said orifice in said wall of said rigid beam comprises an aperture separating said cylindrical tube into first and second sections, said plate being arranged above said first section and connected to said first section via said radial ribs, said first section being connected to said pressurized-fluid supplier, and said second section being closed off by said plate.

19. The canopy according to claim 1, comprising a dismantlable mechanical link, wherein said rigid beam comprises a curved beam having first and second ends, said curved beam being fastened, at said first end, via said dismantlable mechanical link and mounted in an articulated manner so as to pivot at said second end on one of said at least one bearing element.

20. The canopy according to claim 1, wherein said pressurized-fluid supplier comprises an exhauster, including a delivery orifice and an aspiration orifice, and a reversing member operable to reverse a direction of flow of the fluid, said reversing member comprising a hose to be selectively connected to either of said delivery and aspiration orifices and including a reversing-member non-return valve.

21. The canopy according to claim 20, comprising a stop mounted on said aspiration orifice, wherein said reversing-member non-return valve is, in a position in which said hose is connected to said delivery orifice, displaceable by the pressurized fluid between an open position and a closed position, and said reversing-member non-return valve is, in a position in which said hose is connected to said aspiration orifice, held in an open position by said stop.

22. The canopy according to claim 20, wherein said upper inflatable beam is connected directly and permanently to said delivery orifice of said exhauster by a flexible hose and an upper-beam non-return valve.

23. The canopy according to claim 1, comprising at least one lifting cushion operable to lift said upper inflatable beam during refolding of said canopy, said at least one lifting cushion being inflatable, and retractable by deflation, and being arranged between said upper inflatable beam and one of said at least one bearing element.

24. The canopy according to claim 23, wherein said pressurized-fluid supplier comprises an exhauster, including a delivery orifice, and said at least one lifting cushion comprises a plurality of superposed cushions, including a lower lifting cushion, connected to one another and to said upper inflatable beam, said superposed cushions each comprising an orifice, each having a non-return valve, providing a passage for the fluid from said lower lifting cushion towards the other superposed lifting cushions and said upper inflatable beam, said lower lifting cushion being connected directly and permanently to said delivery orifice of said exhauster via a flexible hose.

25. The canopy according to claim 1, wherein said at least one bearing element is trough-shaped with a concave face matching a shape of a lower half of one of said inflatable beams, at least one of said bearing elements, being trough-shaped, forming a receptacle for receiving said inflatable beams during a deflated state of said inflatable beams.

26. The canopy according to claim 1, wherein each bearing element is arch-shaped, has two ends, extends parallel to said inflatable beams, is fastened to the ground at said two ends, and is supported by said rigid beam.

27. The canopy according to claim 26, wherein each bearing element is also trough-shaped and comprises at least one beam extending parallel to said inflatable beams, a series of arches carried by said at least one beam, and stretched fabric bearing on said series of arches.

* * * * *